US005192128A

United States Patent [19]

Ngai

[11] Patent Number: 5,192,128

[45] Date of Patent: Mar. 9, 1993

[54] LENSED LUMINAIRE WITH LENS BRIGHTNESS CONTROL AND METHOD

[75] Inventor: Peter Y. Y. Ngai, Danville, Calif.

[73] Assignee: Peerless Lighting Corporation, Berkeley, Calif.

[21] Appl. No.: 709,838

[22] Filed: Jun. 4, 1991

[51] Int. Cl.[5] ..... F21V 5/02; F21V 7/00

[52] U.S. Cl. ..... 362/297; 362/221; 362/222; 362/225; 362/300; 362/346

[58] Field of Search ..... 362/297, 298, 300, 349, 362/219, 221, 222, 260, 346, 217, 225

[56] References Cited

U.S. PATENT DOCUMENTS

| | | | |
|---|---|---|---|
| Re. 33,593 | 2/1987 | Herst et al. . | |
| 4,390,930 | 6/1983 | Herst et al. . | |
| 4,414,609 | 11/1983 | Shemitz | 362/297 |
| 4,475,147 | 10/1984 | Kristofek | 362/297 |
| 4,531,180 | 7/1985 | Hernandez | 362/297 |
| 4,644,454 | 10/1987 | Ngai . | |
| 4,698,734 | 7/1990 | Herst et al. . | |
| 4,939,627 | 5/1991 | Herst et al. . | |
| 5,032,959 | 7/1991 | Brass | 362/297 |

FOREIGN PATENT DOCUMENTS

| | | | |
|---|---|---|---|
| 493738 | 6/1953 | Canada | 362/221 |

OTHER PUBLICATIONS

John E. Kaufman, IES Lighting Handbook, Fourth Edition 1966, pp. 3-8, 6-1, 6-2, 6-3.

*Primary Examiner*—Ira S. Lazarus

*Assistant Examiner*—Y. Quach

*Attorney, Agent, or Firm*—Donald L. Beeson

[57] ABSTRACT

A luminaire, and typically an indirect luminaire, is provided with at least one visible lens element or other light transmissive media, the observable brightness of which is intended to enhance the performance of the luminaire in terms of providing a psychologically pleasing lighting environment. The brightness induced in the lens element is controlled by directing source light to the lens through a confined indirect light path provided by reflector components within the luminaire. Additionally, a light shield is provided internally of the luminaire to prevent direct source light from reaching the lens element. Preferably, at least one of the reflector components in the indirect light path is a diffuse reflector such that source light incident on the lens element is diffuse light. The amount of diffused source light reaching the lens element along the indirect light path is controlled by adjusting the size of an aperture disposed in the light path; any contributions to lens brightness from light reflected back from interior wall surfaces can be controlled or eliminated, if needed or desired, by a separate light shield element provided for this purpose. In accordance with the invention, the level of lens brightness can readily be controlled and the effects of the surrounding mounting environment for the fixture on lens brightness minimized or eliminated. Also eliminated will be the potential for hot spots on the lens, while overall uniformity of lens brightness will be improved.

34 Claims, 4 Drawing Sheets

LENSED LUMINAIRE WITH LENS BRIGHTNESS CONTROL AND METHOD

BACKGROUND OF THE INVENTION

The present invention generally relates to the field of lighting, and more particularly to luminaires for indirect lighting which employ lens elements or other light transmissive media as a visible source of brightness.

With indirect lighting the light source is not seen directly. Rather, an interior space is illuminated by reflecting source light from interior wall surfaces. The result is a more even distribution of light and a reduction in contrast brightness that can produce glare. Because of this quality indirect lighting has become particularly advantageous in the open office environment where video display terminals (VDTs) are now prevalent and where uncomfortable glare on VDT screens produced by contrast brightness leads to operator fatigue and, some now believe, long term health problems.

A disadvantage of indirect lighting is that it tends to produce a dull lighting environment, sometimes called a "cloudy day effect." The dullness often associated with indirect lighting has heretofore been overcome by providing indirect lighting fixtures with visible lens elements that capture a portion of the source light and direct some of this light into normal viewing angles for the fixture, that is, angles below the plane of the fixture at which the fixture would be in the line of sight of persons within the illuminated space. The lens' visibility gives the observer a perception of source brightness and consequently the psychological advantage of being able to visually locate the light source.

But the effective use of such lens elements depends on the ability of the lighting designer to control the level of brightness and brightness uniformity on the observable lens surface. The desired result is a low brightness lens that provides just a hint of source indicative brightness to the observer, yet avoids the discomfort of excessive brightness and glare producing contrast brightness normally associated with direct lighting. Previously, lens brightness control has been achieved by designing lens prisms to direct a small amount of light only into normal viewing angles as disclosed in U.S. Pat. No. 4,390,930. Another patent, U.S. Pat. No. 4,698,734, discloses a special prismatic lens design that reduces troublesome hot spots, that is, small areas of intense brightness, that tend to appear on the faces of individual prisms at particular viewing angles.

However, lens design alone has proven inadequate to achieve acceptable lens brightness control and suppression of hot spots in all situations. This is particularly the case with lighting fixtures that use compact, high intensity fluorescent lamps, such as the Biax lamp manufactured by General Electric Company. Such lamps emit a large amount of light from a relatively small surface area as compared to more conventional fluorescent tubes, therefore making it difficult to control lens brightness by means of prism design. This problem is discussed in U.S. Pat. No. 4,939,627, which discloses to produce source brightness in a lens element by means of light reflected from surrounding ceiling or wall surfaces, referred to as a "secondary light source", rather than light received directly from the fluorescent lamp itself. Inducing lens brightness from such a secondary source of light eliminates hot spots and will generally produce greater uniformity in lens brightness. Nonetheless, such an approach has a distinct disadvantage: the brightness induced in the lens will be determined by the mounting environment for the lighting fixture and consequently will be difficult to predict. More specifically, the mounting or suspension distances for the lighting fixture will have a substantial effect on the lens brightness, as will the reflectivity of the surface which acts as the secondary source for the lens. For example, a fixture suspended very close to a ceiling having a highly reflective surface might produce a lens brightness that is uncomfortably high, while on the other hand a fixture suspended or mounted well below the ceiling surface, particularly one that has a low reflectivity, may produce no perceptible brightness at all. Thus, the indirect lighting fixture disclosed in U.S. Pat. No. 4,939,627 is not well adapted to a wide variety of installation environments. In particular, it is not well adapted to low mounting heights such as would be the case with an indirect fixture mounted slightly above eye level to an office furniture system.

Another disadvantage of the lens brightness control technique of U.S. Pat. No. 4,939,627 is that patterns, such as ceiling tile patterns, on ceiling or wall surfaces behind the fixture tend to be reflected through the lens. The result is that at certain viewing angles the lens will exhibit distinct shadow areas corresponding to these surface patterns. Also, the brightness of portions of the lens may vary depending on the angle at which the lens is viewed due to variations of brightness on the wall or ceiling surface. For example, in a suspended linear lighting fixture having linear lens elements extending the length of the fixture, the brightness of the ends of the lenses may diminish or become shadowy when viewed from a side angle due to the fact that the light pattern on the ceiling falls off rapidly beyond the ends of the fixture.

Thus, while the lens brightness control technique disclosed in U.S. Pat. No. 4,939,627 gives the designer the ability to achieve desired low brightness levels without hot spots on the lens using either conventional or compact high density fluorescent lamps, the problem of achieving desired brightness levels in varied mounting environments still exist as does the problem of achieving uniform brightness under all conditions and at a wide variety of viewing angles for the fixture.

The present invention overcomes the disadvantages of the indirect lighting fixture and system disclosed in U.S. Pat. No. 4,939,627 by providing a novel optical system that induces uniform low brightness in the lens elements of a lensed indirect lighting fixture, and does so in a way that is substantially unaffected by the fixture's mounting environment or the fixture's proximity to interior wall or ceiling surfaces. The invention permits the designer to easily establish any desired brightness level in the lens so the fixture can be adapted to a wide variety of architectural lighting environments. Additionally, in accordance with the invention, lens brightness can be made to be adjustable within the fixture such that brightness adjustments can be made after a fixture is installed. The fixture may be particularly adapted for use at low mounting heights such as on office furniture partitions where the intensity of ceiling reflected light is greatly diminished.

SUMMARY OF THE INVENTION

Briefly, the invention involves providing a confined path of indirect light between the luminaire's light source and a visible light transmissive element, such as a prismatic lens, associated with the luminaire. The indirect light path is confined within the luminaire such that the length of the path is independent of surrounding interior surfaces. In accordance with the invention, the brightness of the luminaire's light transmissive element is induced by indirect source light directed along such a confined path, as opposed, or possibly in addition to, indirect source light reflected back to the luminaire from the interior space. The brightness of the light transmissive element is thereby internally controlled thereby eliminating the effects of the structural environment on the performance of this element in terms of both its brightness level and brightness uniformity.

As mentioned, the luminaire's light transmissive element will preferably be a prismatic lens. However, it is not intended that the invention be so limited. The invention allows for the possible use of other forms of light transmissive media, notably the possible use of a diffuser element. While, for convenience, reference hereafter is made to lenses, it will be understood that other media that transmit light could be used. It is also understood that while a visible brightness element will find most application in indirect lighting, the application of the invention is not so limited. The invention ma have application in any luminaire product, including a direct luminaire product, where a controlled brightness element is desired.

The confined indirect light path between the luminaire's light source and its lens element or elements is produced by a reflector means within the luminaire. The reflector means for each lens element is comprised of one, preferably two, and possibly more individual reflector components which are preferably diffuse (non-specular) reflectors, but which might include specular reflector components designed to prevent a full specular image of the light source from being projected onto the lens. For example, a contoured specular reflector might be used in limited applications. The reflector means might also include the use of a lensed reflector system as disclosed is applicant's co-pending application Ser. No. 07/387,127.

Further in accordance with the invention, means are provided for shielding the luminaire's lens element from receiving source light directly from the luminaire's light source such that the brightness in the lens element is determined substantially entirely by indirect source light. In its preferred mounting environment, the brightness in the lens will be governed substantially entirely by the source light reflected through the reflector means within the luminaire itself, however, it is understood that contributions to lens brightness may in addition be made by reflected light from surrounding wall or ceiling surfaces. Generally, brightness contributions from reflected light from outside the luminaire will be insignificant where the luminaire is mounted well below or away from a ceiling or wall surface, such as a luminaire mounted to the top of a wall partition for modular office furniture where the partition has a height that is just above eye level. In situations where, for example, the fixture is suspended immediately below a ceiling surface, say at typical suspension distances of 12" or 18", additional shielding of the lens can be provided to remove the influence of the secondary ceiling reflected light on the brightness performance of the lens. Thus, it can be seen that on aspect of the invention is to indirectly induce brightness in a lens element of a luminaire with indirect light which is confined to the luminaire and which does not project the high brightness of the luminaire's light source onto the lens. The ability to control the level and uniformity of lens brightness is thereby enhanced. Another aspect of the invention is to provide a means for controlling the amount of indirect light directed by the reflector means onto the lens element. Such means preferable includes an aperture disposed within the housing which intercepts the indirect path of light between the light source and the lens element. It is contemplated that the size of the aperture can be preadjusted during fabrication of the luminaire to achieve desired lens brightness levels. It is further contemplated that the aperture can be provided with an adjustment feature for post installation adjustment of lens brightness. Aperture size adjustment could be achieved in a number of ways readily implemented by persons skilled in the art, including a remote adjustment feature if desired. Ultimately, the designer, installer, or user of the luminaire will have the flexibility to fine tune lens brightness to meet a variety of lighting requirements and environments.

Another means of adjusting lens brightness would include adjusting the angles of the internal reflectors of the reflector means.

It is therefore a primary object of the present invention to provide a luminaire, and particularly an indirect luminaire, with a lens or other light transmissive element that produces a desired amount of observable brightness that can be controlled substantially independently of the mounting environment for the luminaire. It is a further object of the invention to provide such a luminaire wherein the lens brightness is adjustable before, during, or after its installation. It is yet another object of the invention to eliminate lens hot spots and to increase brightness uniformity in the lens. Still other objects of the invention will become apparent from the following specification and claims.

DETAILED DESCRIPTION OF THE ILLUSTRATED EMBODIMENT

Figure 1:
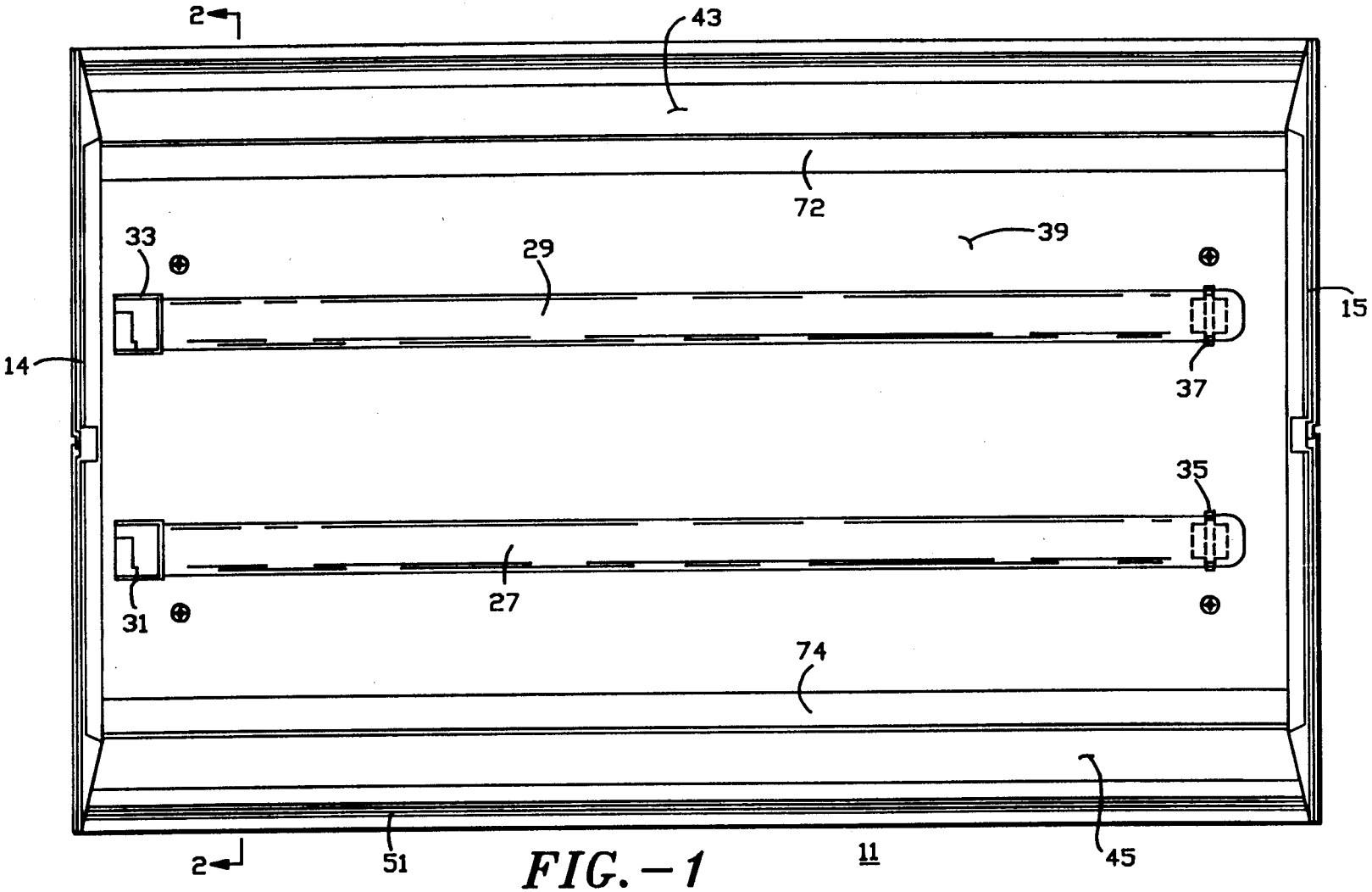
FIG. 1 is a top plan view of an indirect lensed luminaire with lens brightness control in accordance with the invention.
Figure 2:
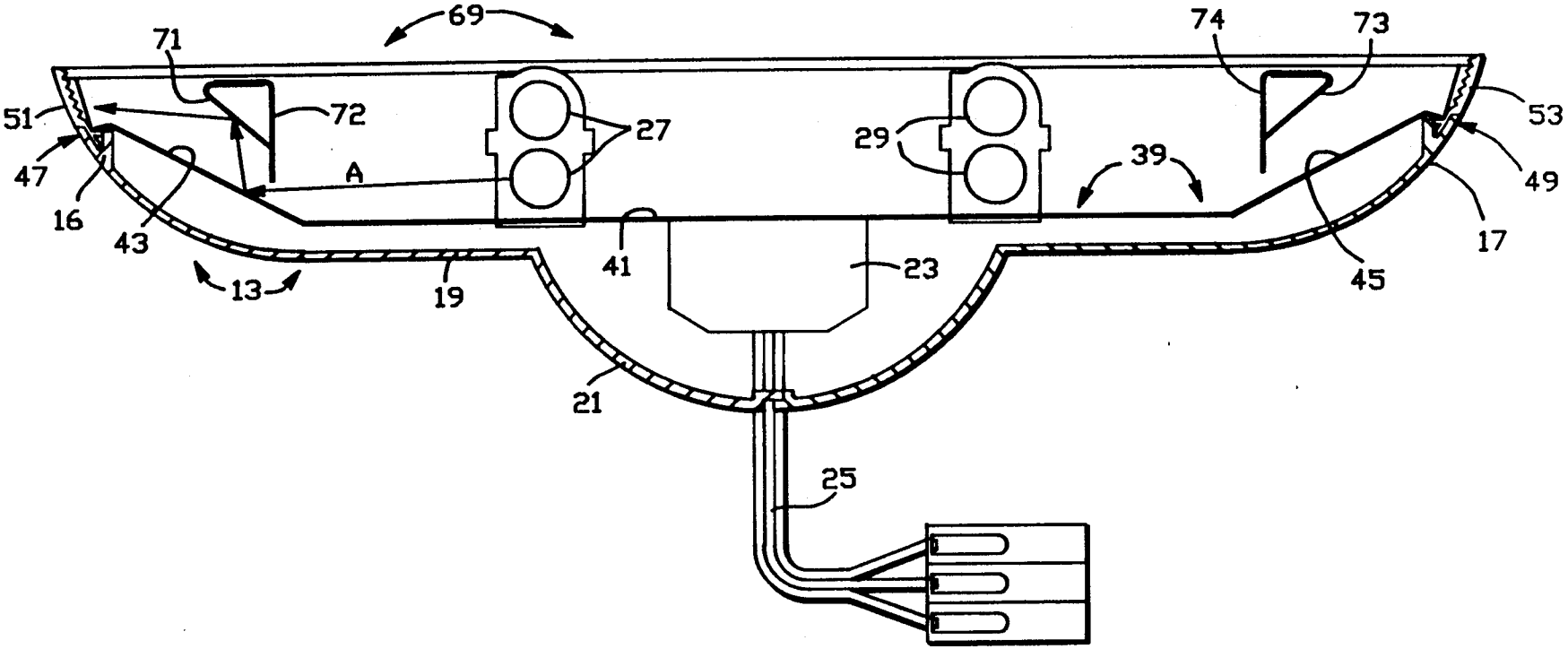
FIG. 2 is a cross-sectional view thereof taken along section lines 2—2 of FIG. 1.

Referring now to the drawings, there is shown an indirect luminaire which can be mounted to a vertical wall surface, suspended from an overhead ceiling, or mounted to the top of an office furniture system or wall partition, all using mounting or suspension hardware and techniques known in the art. As shown, the luminaire, generally denoted by 11, includes an opaque housing 13 capped at opposite ends by end plates 14, 15. The bottom of the housing has a flat bottom wall 19 and a centrally disposed channel 21 containing a lamp ballast 23 and ballast wires 25; the housing further has defined side walls 16, 17, each formed by a curved upward extension of the housing bottom wall.

A light source is provided within the housing. The light source is comprised of two U-shaped compact high intensity lamps 27, 29 held by lamp sockets 31, 33 and brackets 35, 37 over a bottom reflector 39. The reflector 39 is seen to have a flat central reflector surface 41 and opposite side reflector surfaces 43, 45 that extend upwardly at an angle from the central reflector surface to a position at 47, 49 proximate the top of the housing's side walls. As hereinafter described, side reflector surfaces 43, 45 will act as primary reflectors for directing source light along an indirect light path to the luminaire's visible light transmissive elements.

Figure 3B:
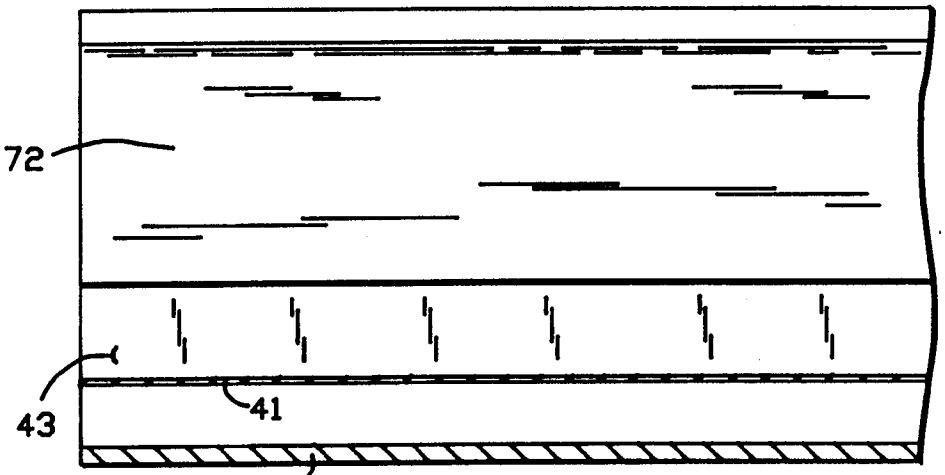
FIG. 3B is a fragmentary cross-sectional view thereof as seen from lines 3B—3B.
Figure 3A:
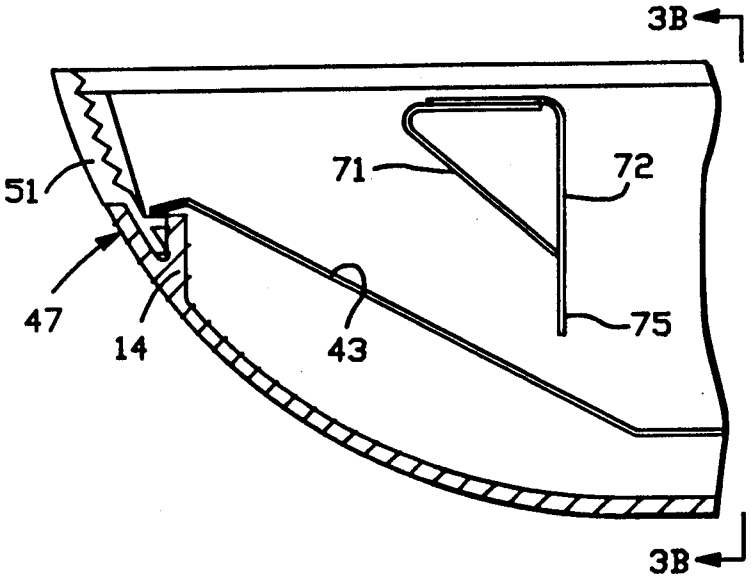
FIG. 3A is an enlarged fragmentary cross-sectional view of the indirect luminaire as shown in FIG. 2 showing in greater detail the structure and mounting of the lens and secondary reflector.

The luminaire 11 is provided with visible light transmissive elements which will be in the line of sight of a person to the side and below the luminaire. The light transmissive elements are in the form of linear side lenses 51, 53 mounted in lens mounting channels in the top edges of the opposite housing side walls, such as mounting channel 55 formed in the top edge of the housing's side wall 16 as shown in FIGS. 3A and 4A. As best see in FIGS. 3A and 4A, the lens 51 has a base portion 52 which fits snugly inside the mounting channel 55: the lens extends upwardly from this base portion to provide a light transmissive extension to the otherwise opaque side wall. The top edges of the side lenses 51, 53, together with the top edges of the end plates 14, 15, generally define a luminaire top opening 69 through which light emitted by lamps 27, 29 is directed to an overhead ceiling and/or adjacent wall surface. As is readily apparent, light emitted through the top opening includes source light emitted directly from the light source as well as light reflected from the reflector 39.

Secondary reflectors, combine with the primary reflectors formed by side reflector surfaces 43, 45 to provide an indirect light path from the lamps 27, 29 to the lens elements 51, 53. Specifically, elongated secondary reflectors 71, 73 are mounted in the housing between the two end plates 14, 15 proximate and in opposition to each of the side lens elements; the reflecting surfaces of these secondary reflectors face downward toward the primary reflectors at an angle which produces a desired reflected light path, such as denoted by the letter "A". Preferably, both primary reflectors and the reflecting surfaces of the secondary reflector are diffuse reflectors which provide a diffuse source of indirect light to the lenses. Generally, in terms of the light reaching the lens elements, a high degree of specularity should be avoided to prevent hot spots on the lens. However, it is possible that special optical effects might be produced by a reflector means which is specular but which controls the source light passing therethrough by contoured reflector surfaces.

It is seen that the secondary reflectors 71, 73 are secured in their position adjacent the side lenses 51, 53 by means of elongated brackets 72, 74 which extend between and are attached to the housing end plates 14, 15. As best shown in FIGS. 3 and 4, each reflector bracket includes a light shield wall 75 which serves as a means within the housing for shielding the lenses from direct illumination by the lamps 27, 29. Thus, the brightness of each lens element is determined in substantial part if not entirely by indirect source light reflected first by the primary reflectors 43, 45 and then by the secondary reflectors 71, 73. As can further be seen in FIGS. 3 and 4, the light shield wall 75 extends downward towards the bottom reflector so as to form an effective aperture 77 in front of the side reflector surface 43. The size of this aperture will provide a means for controlling the amount of source light reaching the lens or other light transmissive element along the indirect light path "A" shown in FIG. 1. Thus, the size of the reflector bracket, and particularly the length of the light shield wall thereof, can be chosen to produce a desired lens brightness.

Figure 4B:
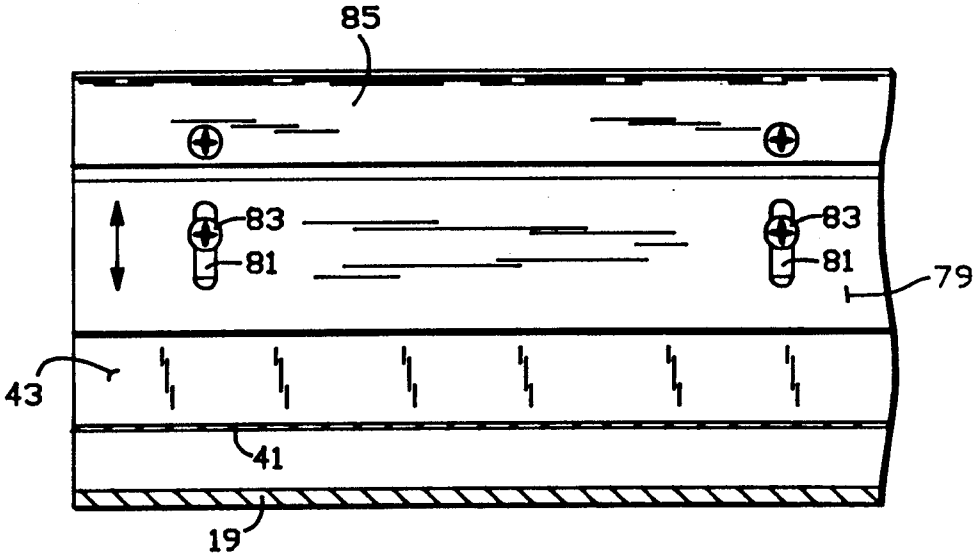
FIG. 4B is a fragmentary cross-sectional view thereof as seen from lines 4B—4B.
Figure 4A:
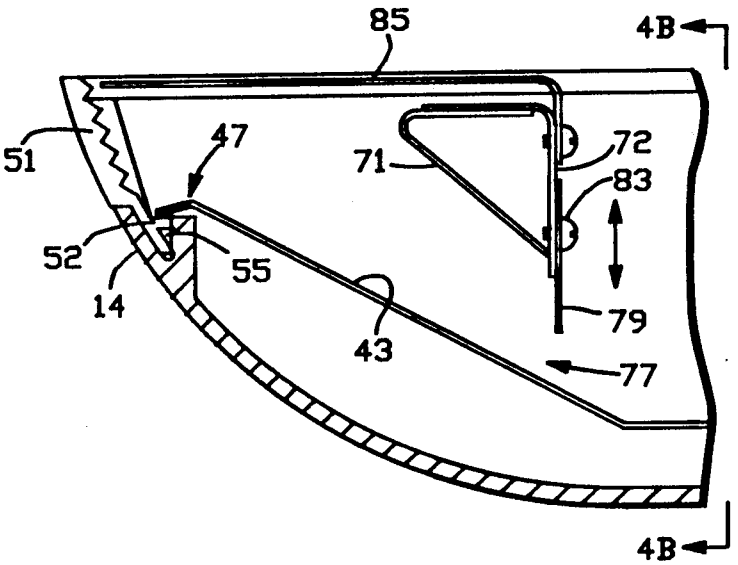
FIG. 4A is a fragmentary cross-sectional view of a luminaire as shown in FIG. 3A showing an alternative adjustable aperture feature and an alternative top light shield for blocking ceiling reflected light.

An alternative light shield wall construction which is adjustable is shown in FIGS. 4A and 4B. In the FIGS. 4A–4B embodiment, an extension member 79 secured to bracket 72 has adjustment slots 81 for receiving adjustment screws 83. Using this alternative embodiment, the size of the aperture 77 can be readily adjusted on site by simply loosening the adjustment screws 83 and positioning the extension member up or down to the extent of the adjustment slots 81. This can be done while observing the brightness changes in the lens element 51. It is understood that other means for adjusting the aperture for adjusting the brightness of the lens could be provided including electronic actuation means for remote adjustment.

It further understood that lens brightness might be adjusted by means other than or in addition to the illustrated adjustment of aperture 77. For example, the relative amount of source light reaching the lens 51 may be altered by rotating the mounting of secondary lens 71 to change the lens' reflection angle. Indeed, bracket 72 could be secured to the end plates 14, 15 by means of a simple rotatable mounting structure (not shown).

As above mentioned, the brightness of the side lenses 51, 53 will, at least in part, be induced internally of the fixture by indirect source light directed along the reflected light path "A" shown in FIG. 1. However, it is understood that some brightness in the light transmissive element may be induced from light reflected from an overhead ceiling or adjacent wall surface in the manner described in U.S. Pat. No. 4,939,627. The amount of brightness induced by such external indirect light will depend on the proximity of the fixture to a reflecting wall surface and the reflectivity of the surface. As previously discussed, for luminaires mounted close to a ceiling surface, the contribution of external indirect light to lens brightness may be substantial. Where desired, such external contributions can be eliminated altogether as shown in FIG. 4A, by providing a top light shield element 85 which extends outwardly from the reflector bracket 72 to near the top of the lens 51.

Therefore, it is seen that the present invention provides a lensed luminaire, and particularly a lensed indirect luminaire, having a controlled amount of lens brightness that can be produced uniformly over the visible surface of the lens. The induced lens brightness will be substantially independent of the mounting environment of the luminaire with the absolute brightness levels being readily adjusted as desired for a particular lighting application. While the present invention has been described in considerable detail in the foregoing specification, it shall be understood that it is not intended that the invention be limited to such detail, except as necessitated by the following claims.

What I claim is:

1. A luminaire comprising a housing, a light source associated with said housing, a light transmissive element mounted in relation to said housing for receiving light from said light source and for transmitting at least a portion of said light into normal viewing angles such that, when the luminaire is observed at such normal viewing angles, said light transmissive element acts as a source of observable brightness, reflector means disposed in said housing between said light source and said light transmissive element for reflecting source light along an indirect light path to said light transmissive element for inducing observable brightness in said light transmissive element, and means along said indirect light path for producing a substantially specular reflection from said reflector means so that said light transmissive element receives substantially source light, means for shielding said light transmissive element from direct illumination by said light source such that the observable brightness of the light transmissive element is determined substantially entirely by indirect source light.

2. The luminaire of claim 1 wherein said reflector means includes a primary reflector and a secondary reflector both of which are positioned proximate said light transmissive element in the light path between said light source and said light transmissive element.

3. The luminaire of claim 2 wherein said secondary reflector has a preadjusted angle relative to said light path for preadjusting the brightness of said light transmissive element.

4. The luminaire of claim 2 wherein at least one of said primary and secondary reflectors is a diffuse reflector.

5. The luminaire of claim 2 wherein both said primary and secondary reflectors are diffuse reflectors.

6. The luminaire of claim 1 wherein said shielding means is disposed in said housing so as to define an aperture sized to control the amount of light directed by said reflector means to said light transmissive element.

7. The luminaire of claim 6 wherein said shielding means is adapted for preadjustment of the size of said aperture for preadjustment of the brightness of said light transmissive element.

8. The luminaire of claim 6 wherein the position of said shielding means is adjustable within said housing to permit adjustment of the size of said aperture to thereby adjust the brightness of said light transmissive element.

9. The luminaire of claim 1 wherein said luminaire is an indirect luminaire.

10. An indirect luminaire comprising housing having at least one opaque side wall, a light source within said housing, a light transmissive element mounted to the opaque sidewall of said housing for receiving light from said light source and for transmitting at least a portion of said light into normal viewing angles such that, when the luminaire is observed at such normal viewing angles, said light transmissive element acts as a source of observable brightness, non specular reflector means disposed in said housing between said light source and said light transmissive element for reflecting source light to said light transmissive element along an indirect light path for inducing observable brightness in said light transmissive element, and means within said housing for shielding said light transmissive element from direct illumination by said light source such that observable brightness of the light transmissive element is determined substantially entirely by indirect source light that behaves in a substantially non-specular fashion.

11. The indirect luminaire of claim 10 wherein said reflector means includes a side reflector surface adjacent said light transmissive element which acts as a primary reflector of source light, and a secondary reflector positioned proximate said side reflector surface for redirecting source light reflected by said side reflector surface to said light transmissive element.

12. The indirect luminaire of claim 11 wherein the shielding mean for said light transmissive element includes bracket means for holding said secondary reflector, said bracket means having a light shield wall disposed to block the light path between said light source and said light transmissive element.

13. The indirect luminaire of claim 11 wherein the shielding means for said light transmissive element includes a light shield wall disposed to block the light path between said light source and said light transmissive element and further disposed to form a defined aperture in front of said primary reflector sized to control the amount of light directed by said reflector means to said light transmissive element.

14. The indirect luminaire of claim 13 wherein the size of said aperture is determined by the length of said light shield wall and the length of said light shield wall is selected to produce a desired brightness in said light transmissive element.

15. The indirect luminaire of claim 13 wherein the size of said aperture is determined by the length of said light shield wall and the length of said light shield wall is adjustable to permit adjustment in the brightness of said light transmissive element.

16. An indirect luminaire comprising a housing having at least one opaque side wall and a defined top opening, a light source within said housing for providing indirect light to an interior space through the defined top opening of said housing, a light transmissive element mounted to the opaque sidewall of said housing for receiving light from said light source and for transmitting at least a portion of said light into a normal viewing angles below said housing such that, when the luminaire is observed at such normal viewing angles, said light transmissive element acts as a source of observable brightness, a bottom reflector extending from substantially beneath said light source to said opaque housing side wall, said bottom reflector including a side reflector surface adjacent said light transmissive element which acts as a primary reflector of source light in the region of said light transmissive element, a secondary reflector positioned to receive reflected source light from said primary reflector and redirect said reflected source light to said light transmissive element, at least one of said primary and secondary reflectors being a substantially non-specular reflector, and a light shield wall disposed to block the light path between said light source and said light transmissive element such that direct source light does not contributes to the observable brightness in said light transmissive element, and further disposed to form a defined aperture in front of said primary reflector, said defined aperture being sized to control the amount of light directed by said primary and secondary reflectors to said light transmissive element to thereby control the brightness of said light transmissive element.

17. The indirect luminaire of claim 16 wherein said secondary reflector is held by an elongated angle bracket secured within said housing in substantially parallel relation to said light transmissive element and wherein said light shield wall is formed by one side of said angle bracket.

18. The indirect luminaire of claim 17 wherein an extension member is secured to said angle bracket for extending said light shield wall to thereby reduce the size of the aperture in front of said primary reflector.

19. The indirect luminaire of claim 18 wherein said extension member is adjustable to permit adjustment of the brightness of said light transmissive element.

20. The indirect luminaire of claim 16 wherein said bottom reflector has a central reflector surface situated in a plane below said light transmissive element for reflecting source light incident thereon generally out through the defined top opening of said housing, and said side reflector surface is angled relative to the plane of said central reflector surface so as to reflect source light incident thereon generally toward said secondary reflector.

21. The indirect luminaire of claim 20 wherein at least one of said primary and secondary reflectors is a diffuse reflector.

22. The indirect luminaire of claim 20 wherein both of said primary and secondary reflectors are diffuse reflectors.

23. The indirect luminaire of claim 20 wherein said light transmissive element is a prismatic lens.

24. An indirect luminaire for providing light to reflective wall surfaces external to the luminaire to thereby produce indirect light, said indirect luminaire comprising a housing having at least one opaque side wall, a light source within said housing, a light transmissive element mounted to the opaque side wall of said housing, and means within said housing for providing a confined indirect light path between said light source and said light transmissive element such that direct source light does not contribute to the observable brightness of said light transmissive element, the length of said indirect light path being independent of the proximity of the luminaire to said external reflective wall surfaces.

25. The luminaire of claim 24 wherein said means for providing a confined indirect light path to said light transmissive element includes means independent of the proximity of said luminaire to said external reflective wall surfaces for controlling the amount of light reaching said light transmissive element for controlling the brightness thereof.

26. The luminaire of claim 25 wherein said means for controlling the amount of light reaching said light transmissive element is adjustable for adjustably controlling the brightness of said light transmissive element.

27. The luminaire of claim 25 wherein the means for controlling the amount of light reaching said light transmissive element includes aperture means disposed in said indirect light path.

28. The luminaire of claim 27 wherein said aperture mean has a defined size which determines the amount of light that can pass therethrough and wherein the size of said aperture means is adjustable.

29. The luminaire of claim 24 wherein said means for providing an indirect light path to said light transmissive element includes a primary and secondary reflector mounted within said housing to provide at least a double reflected light path within said housing between said light source and said light transmissive element.

30. In an indirect luminaire having a normally hidden from view light source and an observable light transmissive element that receives and transmits source light for the purpose of producing an observable source of brightness at angles at which the brightness of said observable light transmissive element comprised essentially of the steps of directing light from said light source to said light transmissive element along an indirect light path, confining said indirect light path within the luminaire such that the length of the indirect light path remains fixed regardless of the mounting environment of the luminaire, and diffusing the source light directed along said indirect light path before it reaches said light transmissive element, other wise shielding said light transmissive element from receiving light directly from said light source such that direct source light does not contribute to the observable brightness of said light transmissive element.

31. The method of claim 30 further comprising the step of controlling somewhere along said indirect light path the amount of light passing to said light transmissive element.

32. The method of claim 31 wherein the amount of source light passing to said light transmissive element along said indirect light path is controlled by an aperture means in said indirect light path.

33. The method of claim 32 wherein the size of the aperture means is adjusted to achieve a desired brightness in said light transmissive element.

34. The method of claim 30 wherein said indirect light path is produced by at least one diffuse reflector element within said luminaire.

* * * * *

UNITED STATES PATENT AND TRADEMARK OFFICE

CERTIFICATE OF CORRECTION

PATENT NO. : 5,192,128

DATED : March 9, 1993

INVENTOR(S) : Peter Y.Y. Ngai

It is certified that error appears in the above—identified patent and that said Letters Patent is hereby corrected as shown below:

Col. 3, line 66, "on" should be --one--.

Col. 7, line 15, "specular" should be --non-specular--.

Col. 7, line 17, after "substantially" insert the left out word, --non-specular--.

Col. 10, line 26, after "at which the" insert the left out words --luminaire is normally viewed, a method of controlling the--.

Signed and Sealed this

Sixteenth Day of November, 1993

Bruce Lehman

*Attest:*

BRUCE LEHMAN

*Attesting Officer*

*Commissioner of Patents and Trademarks*